US011959380B2

(12) United States Patent
Lopes Pereira et al.

(10) Patent No.: US 11,959,380 B2
(45) Date of Patent: Apr. 16, 2024

(54) METHOD TO DETECT REAL-TIME DRILLING EVENTS

(71) Applicant: Halliburton Energy Services, Inc., Houston, TX (US)

(72) Inventors: Vitor Lopes Pereira, The Woodlands, TX (US); Aidan James Porter, Thornton-Cleveleys (GB); Lawrence Joseph Herskowitz, Pearland, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 350 days.

(21) Appl. No.: 16/738,509

(22) Filed: Jan. 9, 2020

(65) Prior Publication Data

US 2020/0284143 A1 Sep. 10, 2020

Related U.S. Application Data

(60) Provisional application No. 62/815,973, filed on Mar. 8, 2019.

(51) Int. Cl.
*E21B 47/12* (2012.01)
*E21B 44/00* (2006.01)

(52) U.S. Cl.
CPC ..... *E21B 47/12* (2013.01); *E21B 44/00* (2013.01)

(58) Field of Classification Search
CPC ..... E21B 44/00; E21B 47/12
See application file for complete search history.

(56) References Cited

U.S. PATENT DOCUMENTS

| | | | |
|---|---|---|---|
| 6,109,368 | A | 8/2000 | Goldman et al. |
| 9,582,764 | B2 | 2/2017 | Dursun et al. |
| 9,934,338 | B2 | 4/2018 | Germain et al. |
| 2004/0040746 | A1 | 3/2004 | Niedermayr et al. |
| 2010/0217530 | A1* | 8/2010 | Boone ..... E21B 41/00 702/9 |

(Continued)

OTHER PUBLICATIONS

Kappal, "Data Normalization using Median & Median Absolute Deviation (MMAD) based Z-Score for Robust Predictions vs. Min-Max Normalization", 2019. (Year: 2019).*

(Continued)

*Primary Examiner* — Andrew Schechter
*Assistant Examiner* — Jeremy A Delozier
(74) *Attorney, Agent, or Firm* — Barnes & Thornburg LLP

(57) ABSTRACT

A method for detecting the occurrence of an event at a well comprising: recording a first set of measurements collected from the well; processing the recorded measurements to provide a first set of data; calculating a first score based on the first set of processed data; recording a second set of measurements collected from the well; processing the second set of recorded measurements to provide a second set of data; calculating a second score based on the second set of processed data; wherein the first set of processed data and the second set of processed data is the number median of absolute difference from normal; combining the first score and the second score using a weighted average; and comparing the combined scores to a predetermined rule based on a specified time frame; and allowing an operator to adjust parameters of the well operation based on the score comparison.

25 Claims, 5 Drawing Sheets

(56) References Cited

U.S. PATENT DOCUMENTS

| | | | | |
|---|---|---|---|---|
| 2013/0124176 | A1* | 5/2013 | Fox | G06F 17/00 703/7 |
| 2014/0214325 | A1 | 7/2014 | Wessling et al. | |
| 2014/0277752 | A1* | 9/2014 | Chang | E21B 44/00 700/275 |
| 2016/0117424 | A1 | 4/2016 | Hohl et al. | |
| 2017/0167245 | A1 | 6/2017 | Dickenson et al. | |
| 2018/0171774 | A1* | 6/2018 | Ringer | E21B 41/0092 |
| 2019/0284926 | A1* | 9/2019 | Tiss | E21B 43/00 |
| 2019/0345809 | A1* | 11/2019 | Jain | E21B 44/005 |

OTHER PUBLICATIONS

International Search Report and Written Opinion date dated May 6, 2020; International PCT Application No. PCT/US2020/013101.

* cited by examiner

METHOD TO DETECT REAL-TIME DRILLING EVENTS

CROSS-REFERENCE TO RELATED APPLICATIONS

This application claims the benefit of and priority to U.S. Provisional Application No. 62/815,973, filed Mar. 8, 2019, which is hereby incorporated by reference.

BACKGROUND

Throughout the lifetime of a well from construction to decommission operational parameters are monitored for trends and events, this may involve vigilance and focus across multiple well-site operations at differing geographic locations. Due to focus requirements on operations there may be limits on the number of operations an operator may monitor simultaneously. As used herein, an operator may include anyone who may monitor well operations. In a non-limiting example, operators may include but are not limited to, a monitoring engineer, an optimization engineer, the like, and/or any combination thereof. By monitoring specific real-time measured and predicted data characteristics and processing said data, detection of when an event is possible or when it is occurring may be automatically highlighted and/or may automatically notify the operator of said event and its occurrence or possible occurrence. Automatic notification of said event(s) may require less attention from the operator thereby increasing the amount/number of operations and/or well-sites an operator may monitor at any given time.

BRIEF DESCRIPTION OF THE DRAWINGS

These drawings illustrate certain aspects of some of the present disclosure, and should not be used to limit or define the disclosure.

DETAILED DESCRIPTION

The disclosed methods and systems may provide a way to automatically detect and alert an operator concerning an event downhole or an event at the surface of the wellsite. Any event downhole may be detected including, but not limited to, hole cleaning, pack off, plugged bit nozzle, influx, losses, sag, pit movements, stuck pipe, surge and swab, hole enlargement, wellbore breathing, bit balling, the like, and/or any combination thereof. Any event at the surface may be detected, including but not limited to, unplanned bulk transfer, spill to sea, unplanned fluid treatment, washout of surface equipment, the like, and/or any combination thereof. Each event may be characterized by a predetermined rule and/or a set of rules based on known parameters and characteristics. Any suitable parameters and/or characteristics may be used. Each rule or set of rules may be specific to an event in which occurrence may be determined. Any suitable rule and/or set of rules may be used and should not be limited herein. Data collected in real-time may be used to calculate scores. In an embodiment, data may be collected from simulations, calculations, in real-time, from coefficient values, the like, and/or any combination thereof. These scores may be compared to the predetermined rule and/or set of rules. In an embodiment, if the scores do not follow the predetermined rules, then the occurrence of an event may have been detected and the operator may be automatically notified of said event. In an embodiment, if the scores do not follow the predetermined rules, then the probability of an event occurring at a time in the future may be detected and the operator may be automatically notified of the possible event. The operator may then adjust the parameters and/or take action to account and/or correct for the detected event and/or possible event. In an embodiment, the automatic detection of an event may be advantageous as it may allow an operator to monitor more operations and/or well-sites. It should be noted that while the present disclosure may be directed towards drilling operations, the disclosed system and methods may be used in any suitable application and should not be limited herein. Suitable downhole applications may include but are not limited to, lost circulation operations, fracturing operations, cementing operations, completion operations, production operations, the like, and any combinations thereof. In an embodiment, the present disclosure may be used to detect and/or plan for any surface events that may occur. In an embodiment, the present disclosure may be used to predict failure of well-site equipment and/or automated well-site equipment.

Figure 1:
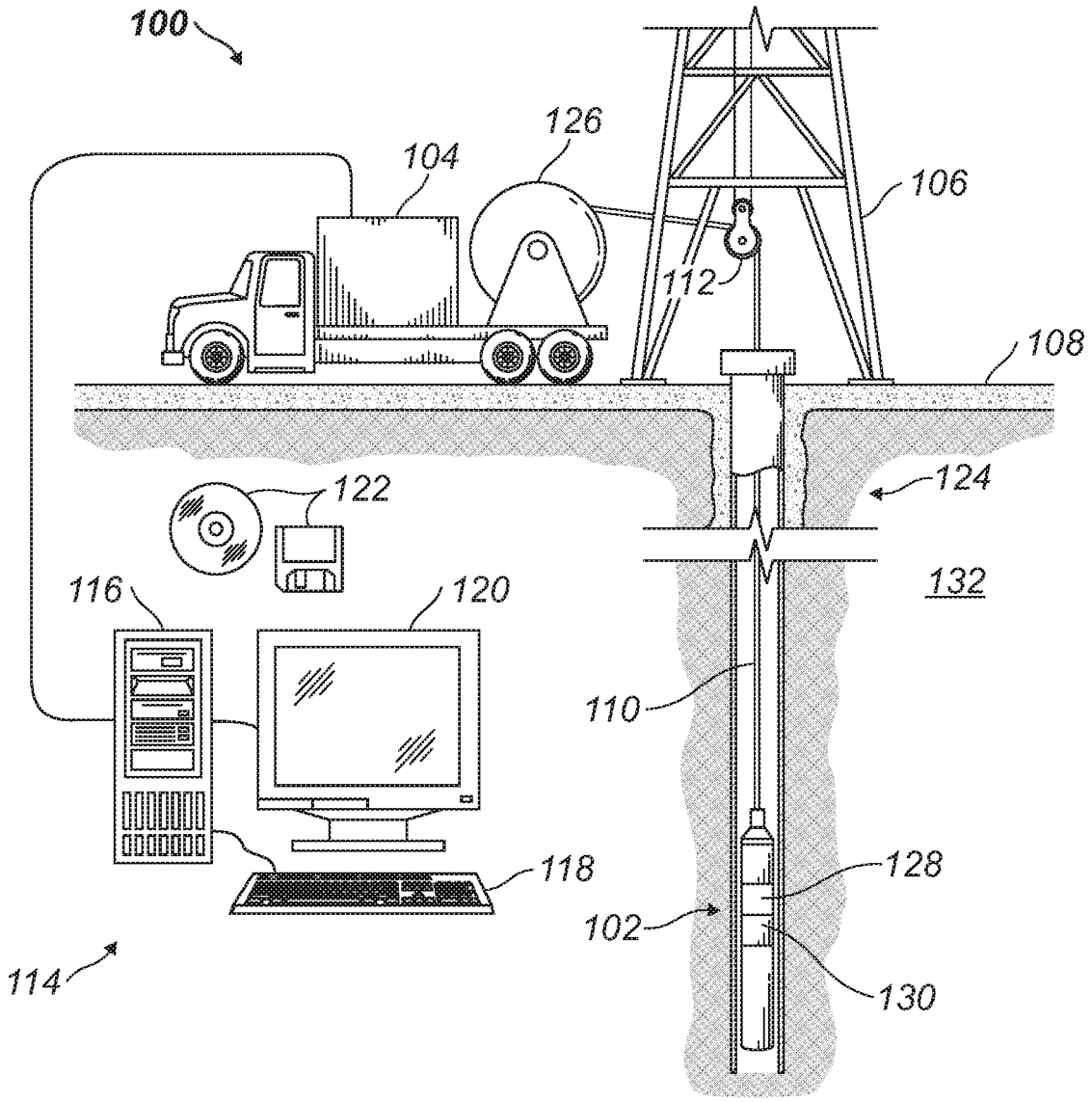
FIG. 1 illustrates a cross-sectional view of a well measurement system.

FIG. 1 illustrates a cross-sectional view of a well measurement system 100. As illustrated, well measurement system 100 may comprise downhole tool 102 attached a vehicle 104. In examples, it should be noted that downhole tool 102 may not be attached to a vehicle 104. Downhole tool 102 may be supported by rig 106 at surface 108. Downhole tool 102 may be tethered to vehicle 104 through conveyance 110. Conveyance 110 may be disposed around one or more sheave wheels 112 to vehicle 104. Conveyance 110 may include any suitable means for providing mechanical conveyance for downhole tool 102, including, but not limited to, wireline, slickline, coiled tubing, pipe, drill pipe, downhole tractor, or the like. In some embodiments, conveyance 110 may provide mechanical suspension, as well as electrical connectivity, for downhole tool 102. Conveyance 110 may comprise, in some instances, a plurality of electrical conductors extending from vehicle 104. Conveyance 110 may comprise an inner core of seven electrical conductors covered by an insulating wrap. An inner and outer steel armor sheath may be wrapped in a helix in opposite directions around the conductors. The electrical conductors may be used for communicating power and telemetry between vehicle 104 and downhole tool 102. Information from downhole tool 102 may be gathered and/or processed by information handling system 114. For example, signals recorded by downhole tool 102 may be stored on memory and then processed by downhole tool 102. The processing may be performed real-time during data acquisition or after recovery of downhole tool 102. Processing may alternatively occur downhole or may occur, downhole, at surface, off-site, and any combination thereof. In some embodiments, signals recorded by downhole tool 102 may be conducted to information handling system 114 by way of conveyance 110. Information handling system 114 may process the signals, and the information contained therein may be displayed for an operator to observe and stored for future processing and reference. Information handling system 114 may process the information using a machine-learning algorithm, a statistical analysis approach, the like, and/or any combination thereof. Information handling system 114 may also contain an apparatus for supplying control signals and power to downhole tool 102.

Systems and methods of the present disclosure may be implemented, at least in part, with information handling system 114. Information handling system 114 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 114 may be a processing unit 116, a network storage device, or any other suitable device and may vary in size, shape, performance, functionality, and price. Information handling system 114 may include random access memory (RAM), one or more processing resources such as a central processing unit (CPU) or hardware or software control logic, ROM, and/or other types of nonvolatile memory. Additional components of the information handling system 114 may include one or more disk drives, one or more network ports for communication with external devices as well as various input and output (I/O) devices, such as a input device 118 (e.g., keyboard, mouse, etc.) and a video display 120. Information handling system 114 may also include one or more buses operable to transmit communications between the various hardware components.

Alternatively, systems and methods of the present disclosure may be implemented, at least in part, with non-transitory computer-readable media 122. Non-transitory computer-readable media 122 may include any instrumentality or aggregation of instrumentalities that may retain data and/or instructions for a period of time. Non-transitory computer-readable media 122 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

In examples, rig 106 includes a load cell (not shown) which may determine the amount of pull on conveyance 110 at the surface of borehole 124. Information handling system 114 may comprise a safety valve which controls the hydraulic pressure that drives drum 126 on vehicle 104 which may reels up and/or release conveyance 110 which may move downhole tool 102 up and/or down borehole 124. The safety valve may be adjusted to a pressure such that drum 126 may only impart a small amount of tension to conveyance 110 over and above the tension necessary to retrieve conveyance 110 and/or downhole tool 102 from borehole 124. The safety valve is typically set a few hundred pounds above the amount of desired safe pull on conveyance 110 such that once that limit is exceeded; further pull on conveyance 110 may be prevented.

Downhole tool 102 may comprise a transmitter 128 and/or a receiver 130. In examples, downhole tool 102 may operate with additional equipment (not illustrated) on surface 108 and/or disposed in a separate well measurement system (not illustrated) to record measurements and/or values from formation 132. During operations, transmitter 128 may broadcast a signal from downhole tool 102. Transmitter 128 may be connected to information handling system 114, which may further control the operation of transmitter 128. Additionally, receiver 130 may measure and/or record signals broadcasted from transmitter 128. Receiver 130 may transfer recorded information to information handling system 114. Information handling system 114 may control the operation of receiver 130. In an embodiment, receiver 130 may transfer recorded information to an off-site network (not illustrated). For example, the broadcasted signal from transmitter 128 may be reflected by formation 132. The reflected signal may be recorded by receiver 130. The recorded signal may be transferred to information handling system 114 for further processing. In examples, there may be any suitable number of transmitters 128 and/or receivers 130, which may be controlled by information handling system 114. Information and/or measurements may be processed further by information handling system 114 to determine properties of borehole 124, fluids, formation 132, when an event may occur, and/or if an event is occurring down hole.

Figure 2:
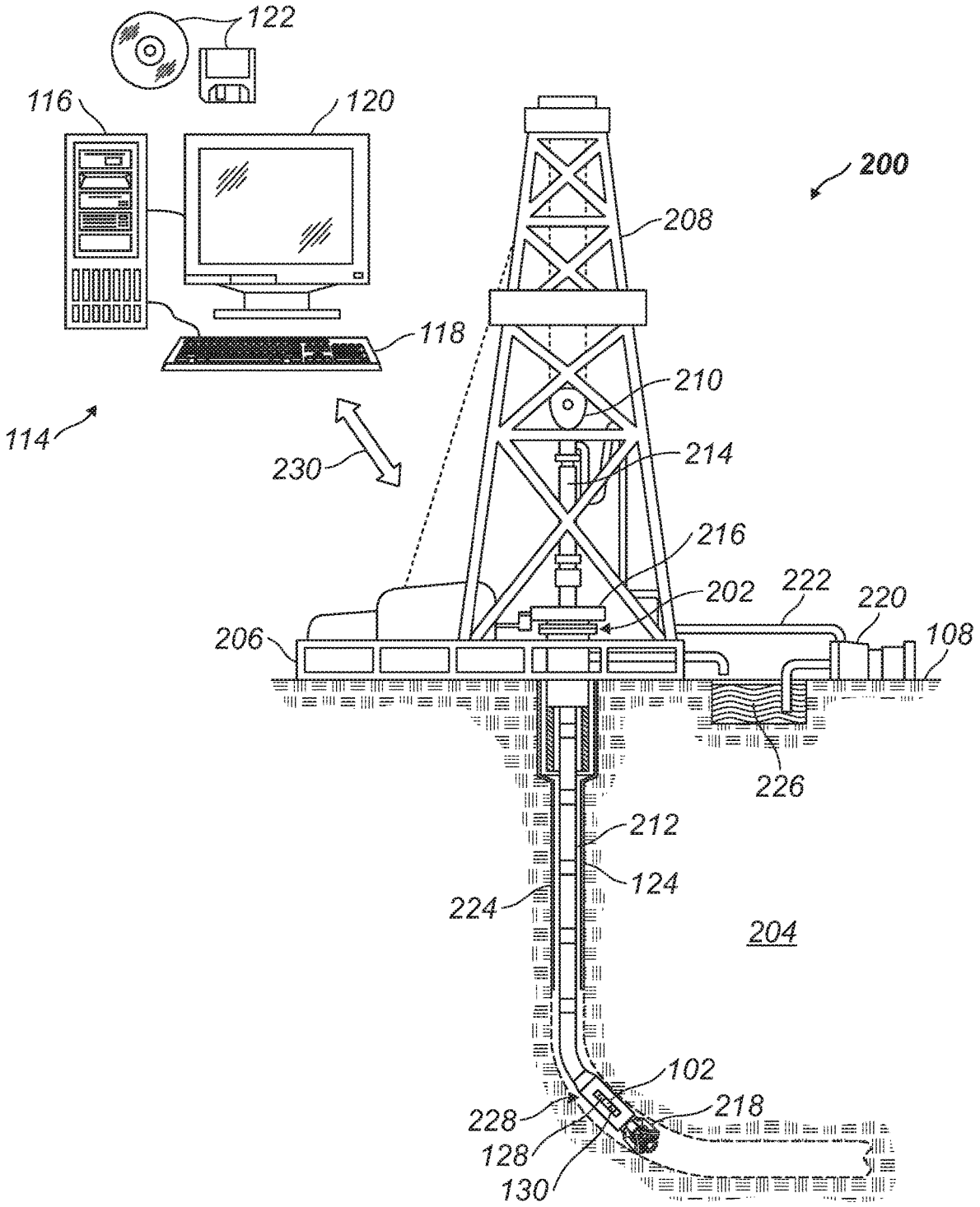
FIG. 2 illustrates an example in which downhole tool may be disposed in a drilling system.

FIG. 2 illustrates an example in which downhole tool 102 (Referring to FIG. 1) may be disposed in a drilling system 200. As illustrated, borehole 124 may extend from a wellhead 202 into a subterranean formation 204 from surface 108 (Referring to FIG. 1). Generally, borehole 124 may include horizontal, vertical, slanted, curved, and other types of wellbore geometries and orientations. Borehole 124 may be cased or uncased. In examples, borehole 124 may comprise a metallic material. By way of example, the metallic member may be a casing, liner, tubing, or other elongated steel tubular disposed in borehole 124.

As illustrated, borehole 124 may extend through subterranean formation 204. As illustrated in FIG. 2, borehole 124 may extending generally vertically into the subterranean formation 204, however borehole 124 may extend at an angle through subterranean formation 204, such as horizontal and slanted wellbores. For example, although FIG. 2 illustrates a vertical or low inclination angle well, high inclination angle or horizontal placement of the well and equipment may be possible. It should further be noted that while FIG. 2 generally depicts a land-based operation, those skilled in the art may recognize that the principles described herein are equally applicable to subsea operations that employ floating or sea-based platforms and rigs, without departing from the scope of the disclosure.

As illustrated, a drilling platform 206 may support a derrick 208 having a traveling block 210 for raising and lowering drill string 212. Drill string 212 may include, but is not limited to, drill pipe and coiled tubing, as generally known to those skilled in the art. A kelly 214 may support drill string 212 as it may be lowered through a rotary table 216. A drill bit 218 may be attached to the distal end of drill string 212 and may be driven either by a downhole motor and/or via rotation of drill string 212 from surface 108. Without limitation, drill bit 218 may include, roller cone bits, PDC bits, natural diamond bits, any hole openers, reamers, coring bits, and the like. As drill bit 218 rotates, it may create and extend borehole 124 that penetrates various subterranean formations 204. A pump 220 may circulate drilling fluid through a feed pipe 222 to kelly 214, downhole through interior of drill string 212, through orifices in drill bit 218, back to surface 108 via annulus 224 surrounding drill string 212, and into a retention pit 226.

With continued reference to FIG. 2, drill string 212 may begin at wellhead 202 and may traverse borehole 124. Drill bit 218 may be attached to a distal end of drill string 212 and may be driven, for example, either by a downhole motor and/or via rotation of drill string 212 from surface 108 (Referring to FIG. 1). Drill bit 218 may be a part of bottom hole assembly 228 at distal end of drill string 212. Bottom hole assembly 228 may further comprise downhole tool 102 (Referring to FIG. 1). Downhole tool 102 may be disposed on the outside and/or within bottom hole assembly 228. Downhole tool 102 may comprise a plurality of transmitters 128 and receivers 130 (Referring to FIG. 1). Downhole tool 102 and/or the plurality of transmitters 128 and receivers 130 may operate and/or function as described above. As will be appreciated by those of ordinary skill in the art, bottom hole assembly 228 may be a measurement-while drilling (MWD) or logging-while-drilling (LWD) system.

Without limitation, bottom hole assembly 228, transmitter 128, and/or receiver 130 may be connected to and/or controlled by information handling system 114 (Referring to FIG. 1), which may be disposed on surface 108. Without limitation, information handling system 114 may be disposed down hole in bottom hole assembly 228. Processing of information recorded may occur down hole and/or on surface 108. Processing occurring downhole may be transmitted to surface 108 to be recorded, observed, and/or further analyzed. Additionally, information recorded on information handling system 114 that may be disposed down hole may be stored until bottom hole assembly 228 may be brought to surface 108. In examples, information handling system 114 may communicate with bottom hole assembly 228 through a communication line (not illustrated) disposed in (or on) drill string 212. In examples, wireless communication may be used to transmit information back and forth between information handling system 114 and bottom hole assembly 228. Information handling system 114 may transmit information to bottom hole assembly 228 and may receive as well as process information recorded by bottom hole assembly 228. In examples, a downhole information handling system (not illustrated) may include, without limitation, a microprocessor or other suitable circuitry, for estimating, receiving and processing signals from bottom hole assembly 228. Downhole information handling system (not illustrated) may further include additional components, such as memory, input/output devices, interfaces, and the like. In examples, while not illustrated, bottom hole assembly 228 may include one or more additional components, such as analog-to-digital converter, filter and amplifier, among others, that may be used to process the measurements of bottom hole assembly 228 before they may be transmitted to surface 108. Alternatively, raw measurements from bottom hole assembly 228 may be transmitted to surface 108. In an embodiment, raw measurements from bottom hole assembly 228 may be transmitted to surface 108, which may then be transmitted to an off-site network for processing.

Any suitable technique may be used for transmitting signals from bottom hole assembly 228 to surface 108, including, but not limited to, wired pipe telemetry, mud-pulse telemetry, acoustic telemetry, and electromagnetic telemetry. While not illustrated, bottom hole assembly 228 may include a telemetry subassembly that may transmit telemetry data to surface 108. Without limitation, an electromagnetic source in the telemetry subassembly may be operable to generate pressure pulses in the drilling fluid that propagate along the fluid stream to surface 108. At surface 108, pressure transducers (not shown) may convert the pressure signal into electrical signals for a digitizer (not illustrated). The digitizer may supply a digital form of the telemetry signals to information handling system 114 via a communication link 230, which may be a wired or wireless link. The telemetry data may be analyzed and processed by information handling system 114.

As illustrated, communication link 230 (which may be wired or wireless, for example) may be provided that may transmit data from bottom hole assembly 228 to an information handling system 114 at surface 108. Information handling system 114 may include a processing unit 116 (Referring to FIG. 1), a video display 120 (Referring to FIG. 1), an input device 118 (e.g., keyboard, mouse, etc.) (Referring to FIG. 1), and/or non-transitory computer-readable media 122 (e.g., optical disks, magnetic disks) (Referring to FIG. 1) that may store code representative of the methods described herein. In an embodiment, data may be transmitted from bottom hole assembly 228 to an off-site network for processing. In addition to, or in place of processing at surface 108, processing may occur downhole.

Bottom hole assembly 228 may comprise a transmitter 128 and/or a receiver 130. In examples, bottom hole assembly 228 may operate with additional equipment (not illustrated) on surface 108 and/or disposed in a separate well measurement system (not illustrated) to record measurements and/or values from subterranean formation 204. During operations, transmitter 128 may broadcast a signal from bottom hole assembly 228.

Transmitter 128 may be connected to information handling system 114, which may further control the operation of transmitter 128. Additionally, receiver 130 may measure and/or record signals broadcasted from transmitter 128. Receiver 130 may transfer recorded information to information handling system 114. Information handling system 114 may control the operation of receiver 130. For example, the broadcasted signal from transmitter 128 may be reflected by subterranean formation 204. The reflected signal may be recorded by receiver 130. The recorded signal may be transferred to information handling system 114 for further processing. In examples, there may be any suitable number of transmitters 128 and/or receivers 130, which may be controlled by information handling system 114. Information and/or measurements may be processed further by information handling system 114 to determine properties of borehole 124 (Referring to FIG. 1), fluids, and/or subterranean formation 204, when an event may occur, and/or if an event is occurring down hole, any combination thereof, and the like.

As discussed below, methods may be utilized by information handling system 114 to determine and alert an operator when an event may occur and/or if an event is occurring. Any suitable event may be determined including but not limited to, hole cleaning, pack off, plugged bit nozzle, influx losses, sag, pit movements, stuck pipe, surge and swab, hole enlargement, wellbore breathing, bit balling, the like, and/or any combination thereof.

Figure 3:
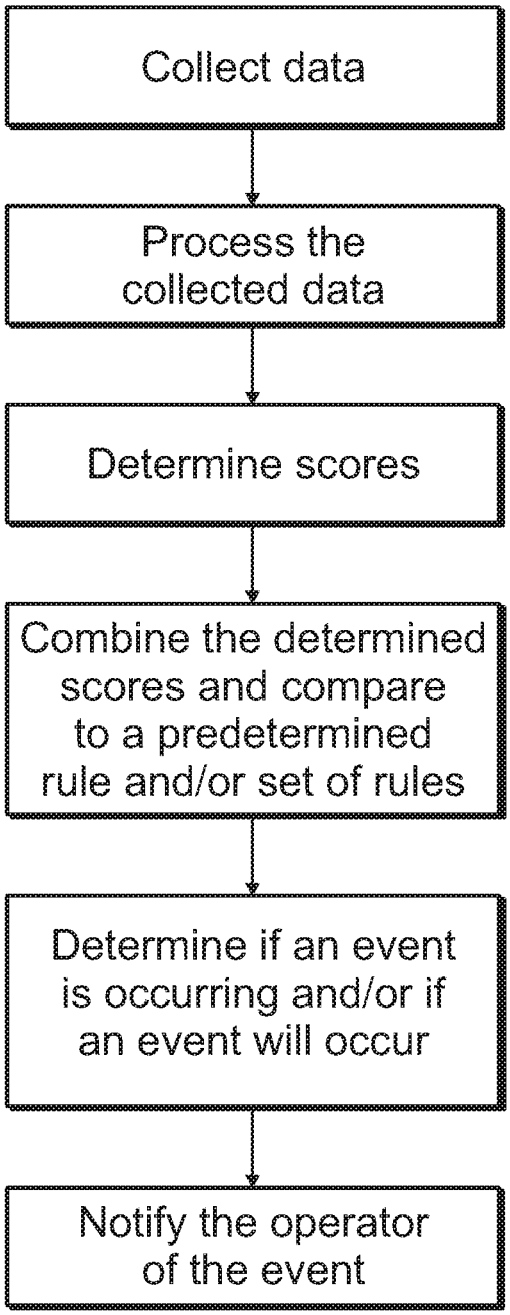
FIG. 3 is a flow diagram illustrating one embodiment of a method for determining the occurrence of an event.

FIG. 3 is a flow diagram illustrating one embodiment of a method for determining the occurrence of an event. First, data may be collected in real-time for a wellbore and/or a plurality of wellbores. In an embodiment, data may be collected from laboratory tests. In an embodiment, data may be collected from surface operations and/or measurements. In an embodiment, data may be collected from production monitoring. In an embodiment, data may be collected from a simulation. The collected data may be transmitted to an information handling system on site where the data may be stored and processed. In an embodiment, the collected data may be transmitted to an off-site network where the data may be stored and processed. In an embodiment, the processor may utilize a statistical approach. In an embodiment, the processor may utilize an artificial neural network for processing. In an embodiment, the data may be processed by any suitable processor and should not be limited herein. The data may then be processed. In an embodiment, the data may be processed utilizing a statistical analysis approach, a machine-learning algorithm, the like, and/or any combination thereof. The data may then be used to determine a score or a set of scores. In an embodiment, the scores may be unitless. Optionally, each score equation may be used to describe the number median of absolute difference the value may be from normal as defined for the window being analyzed. This may allow for each score to be combined. In an embodiment, scores may be combined for any given time period using a weighted average which may be used for various rules in each event detection. In an embodiment, the weighted average may be calculated using feedback, which may be provided by the operator. In an embodiment, the scores may be averaged over any given time period. Any suitable score system, equation, and/or method may be used and should not be limited herein. Examples of suitable score equations may be discussed in more detail below.

In an embodiment, a score may be calculated to determine if the data may be high, low, or outside of range for a given event. This score may be determined using Equation (1), shown below.

$$\text{score} = \frac{d - \text{median}(\vec{w})}{\text{mad}(\vec{w})} \tag{1}$$

In Equation (1), d may denote the current data point being evaluated, median($\vec{w}$) may denote the window of data points in which the current data point may be compared to, and mad($\vec{w}$) may represent the median absolute deviation between the normal difference between a simulated property and the actual property. In certain embodiments, if the calculated score is above or below a predetermined rule and/or set of rules, an event may have occurred and/or an event may be occurring and/or an event may occur within a specified time frame. In certain embodiments, if the calculated score is about the same as the predetermined rule and/or set of rules, an event may have not occurred. In certain embodiments, a calculated score may be about the same as the predetermined rule and/or set of rules when the calculated score(s) has a numerical value(s) that may vary with respect to the numerical value(s) of the predetermined rule/set of rules by about +/−15%.

In an embodiment, a score may be calculated to determine a sustained high value for a given window. In this embodiment, the window being analyzed may be split into three sections. This score may be calculated using Equation (2), shown below.

$$\text{score} = \frac{\text{mean}(\overrightarrow{w_N}) - \text{median}(\overrightarrow{w_H})}{\text{mad}(\overrightarrow{w_H})} \tag{2}$$

In Equation (2), ($\overrightarrow{w_H}$) may denote the oldest data collected within the window being analyzed. In an embodiment, ($\overrightarrow{w_H}$) may also be referred to as the first section of the window being analyzed. ($\overrightarrow{w_N}$) may denote the most recent data collected within the window being analyzed. In an embodiment, ($\overrightarrow{w_N}$) may also be referred to as the third section of the window being analyzed. In an embodiment, the second section may not be used to calculate the score but rather may be used to separate the first section and the third section of the window. In certain embodiments, if the calculated score is above the predetermined rule and/or set of rules for all three sections, an event may have occurred and/or an event may be occurring and/or an event may occur within a specified time frame. In certain embodiments, if the calculated score for at least one section is not is above the predetermined rule and/or set of rules, an event may have not occurred.

In another embodiment, a score may be calculated if it is desired to determine a value above or below a set limit. In an embodiment, the score may be calculated using Equation (3), as shown below.

$$\text{score} = \frac{d - d_{set}}{\text{mad}(\vec{w})} \tag{3}$$

In Equation (3), d may denote the current data point being evaluated, $d_{set}$ may denote the set limit, and mad ($\vec{w}$) may represent the median absolute deviation between the normal difference between a simulated property and the actual property. In certain embodiments, if the calculated score is above or below the predetermined rule or set of rules, an event may have occurred and/or an event may be occurring and/or an event may occur within a specified time frame. In certain embodiments, if the calculated score is about the same as the predetermined rule or set of rules, an event may not have occurred.

The calculated scores may then be added up and compared to historical data and the predetermined rule and/or set of rules. A predetermined rule or set of rules may be established by a person or operator on-site or off-site and may be based on historical data and a scientific understanding of how the well operates. In a non-limiting example, a predetermined rule or set of rules may be established based on historical data and understanding each parameter and what their thresholds are. This predetermined rule or set of rules may be input into the system. If the scores, when compared to the historical data and the predetermined rule and/or set of rules, do not pass the rule and/or set of rules (e.g. provide a score higher than the rule allows for, etc.) this may indicate that an event may have occurred, may be occurring, may not occur, and/or the possibility of when an event may occur. This information may then be automatically transmitted to a display device thereby alerting an operator of the detected event. In an embodiment, the operator may be notified in any suitable manner of the occurrence of an event and should not be limited herein. The operator may then adjust parameters and/or take action to account and/or correct for the detected event and/or possible event. In an embodiment, the operator may not take action after the notification of the occurrence or possibility of occurrence of an event. In an embodiment, the operator may notify another party of the occurrence or possibility of occurrence of an event before taking action, after taking action, while taking action, or any combination thereof. In certain embodiments, the other party notified may respond to the occurrence or possibility of occurrence of an event. The other party may be located on-site or off-site at a remote location.

Figure 4:
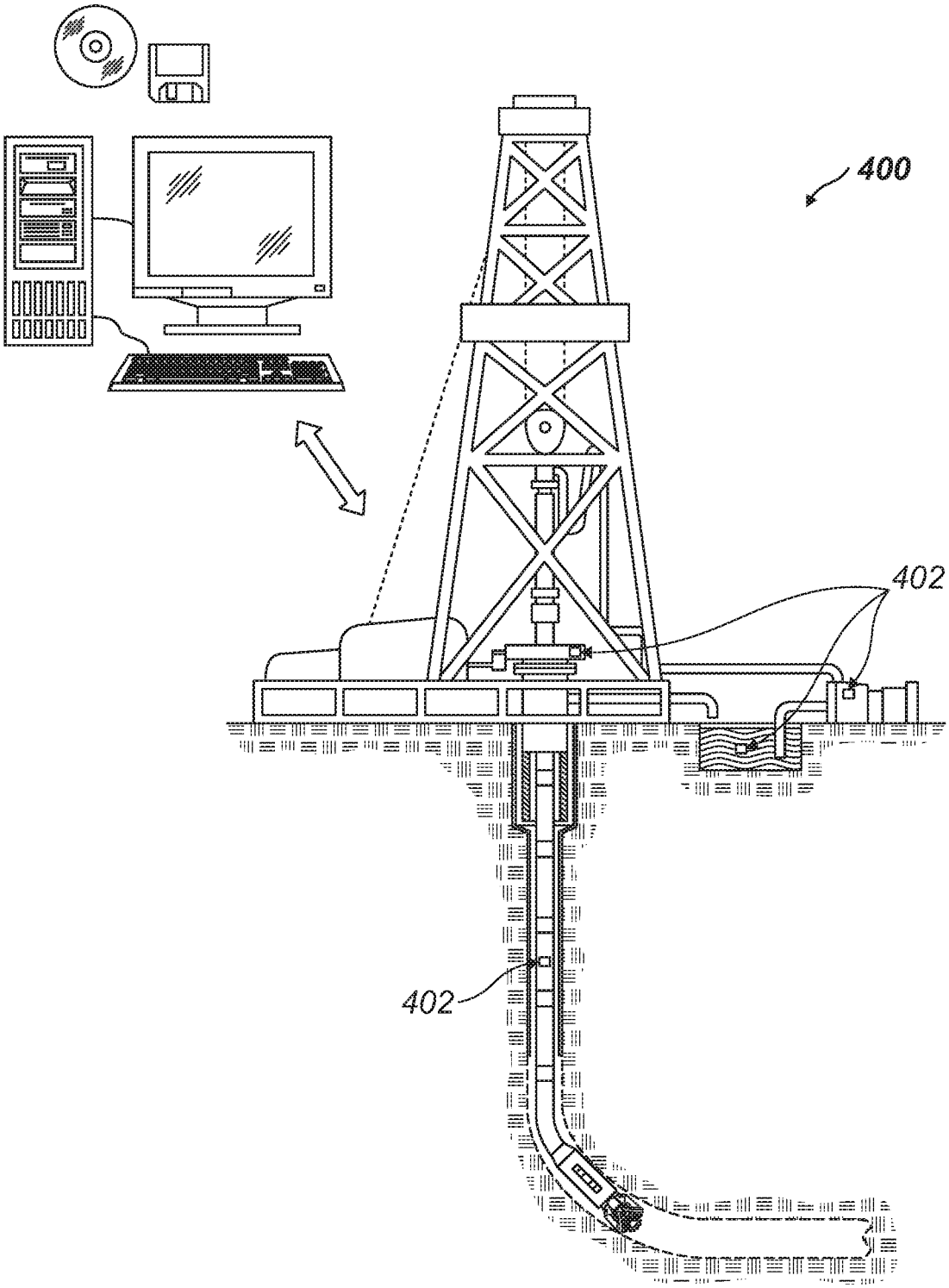
FIG. 4 illustrates an embodiment of a drilling system comprising a sensor and/or a plurality of sensors disposed therein.

FIG. 4 illustrates an embodiment of a drilling system 400 comprising a sensor 402 and/or a plurality of sensors 402 disposed therein. Sensor 402 may be any suitable sensor capable of measuring a property, characteristic, and/or parameter. Suitable sensor 402 may include, but is not limited to, a pressure transducer, flow rate meters, pump stroke sensors, volume sensors, load cells, depth encoders, RPM sensors, torque sensors, mud monitoring equipment, the like, and/or any combination thereof. In an embodiment, drilling system 400 may comprise a plurality of sensors. Plurality of sensors 402 may be the same sensors or different sensors. Sensor 402 or a plurality of sensors 402 may be located at any suitable location within a well-site. Suitable locations may include, but are not limited to, a rig, a choke manifold, standpipe, annulus, wellhead, mud pumps, riser booster, reserve, active pits, skips weights, bulk tanks, draw-works, geolograph wires, compensator wheels, processing equipment, the like, and/or any combination thereof. It should be noted, that these are merely examples and should not limit the present disclosure. A person of ordinary skill in the art, along with the present disclosure, would be able to determine the appropriate types of sensors and their locations for a given application and should not be limited herein. While this is an example of a drilling system, any suitable well-site system and/or application may be used and should not be limited herein.

The treatment fluids may directly or indirectly affect one or more components or pieces of equipment associated with the preparation, delivery, recapture, recycling, reuse, and/or disposal of the treatment fluid particulates. For example, the treatment fluid particulates may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the sealant composition. The treatment fluid particulates may also directly or indirectly affect any transport or delivery equipment used to convey the treatment fluid particulates to a well site or downhole such as, for example, any transport vessels, conduits, pipelines, trucks, tubulars, and/or pipes used to compositionally move the treatment fluid particulates from one location to another, any pumps, compressors, or motors (e.g., topside or downhole) used to drive the treatment fluid particulates into motion, any valves or related joints used to regulate the pressure or flow rate of the treatment fluid particulates (or fluids containing the same treatment fluid particulates), and any sensors (i.e., pressure and temperature), gauges, and/or combinations thereof, and the like. The disclosed treatment fluid particulates may also directly or indirectly affect the various downhole equipment and tools that may come into contact with the treatment fluid particulates such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and correlectrical submersible pumponding actuation devices, tool seals, packers, cement plugs, bridge plugs, and other wellbore isolation devices, or components, and the like.

Accordingly, this disclosure describes systems, methods, and compositions that may relate to subterranean operations. The systems, methods, and compositions may further be characterized by one or more of the following statements:

Statement 1: A method for detecting the occurrence of an event at a well comprising: recording a first set of measurements collected from the well; processing the recorded measurements to provide a first set of data; calculating a first score based on the first set of processed data; comparing the first score to a predetermined rule based on a specified time frame; and allowing an operator to adjust parameters of the well operation based on the score comparison.

Statement 2: The method of statement 1, further comprising: transmitting the recorded measurements to an information handling system for processing; wherein the recorded measurements are processed utilizing a statistical analysis approach, a machine-learning algorithm, and any combinations thereof.

Statement 3: The method of statement 1 or 2, wherein the operator determines the predetermined rule and inputs the predetermined rule into the information handling system.

Statement 4: The method of any of the preceding statements, wherein the first score is calculated using:

$$\text{score} = \frac{d - \text{median}(\vec{w})}{\text{mad}(\vec{w})}$$

wherein d is the first data set; wherein median( $\vec{w}$ ) is a set of data points for the specified time frame in which the first set of data is being compared to; wherein mad ( $\vec{w}$ ) is a median absolute deviation between a normal difference between a simulated first set of measurements and an actual first set of measurements.

Statement 5: The method of any of the preceding statements, wherein if the calculated first score is higher or lower than the predetermined rule an event has occurred.

Statement 6: The method of any of the preceding statements, wherein if the calculated first score is about the same as the predetermined rule an event has not occurred.

Statement 7: The method of any of the preceding statements, wherein the first score is calculated using:

$$\text{score} = \frac{d - d_{set}}{\text{mad}(\vec{w})}$$

wherein d is the first set of data collected; wherein $d_{set}$ is a predetermined set limit; and wherein mad( $\vec{w}$ ) is a median absolute deviation between a normal difference between a simulated first set of measurements and an actual first set of measurements.

Statement 8: The method of any of the preceding statements, wherein if the calculated first score is above or below the predetermined rule an event has occurred.

Statement 9: The method of any of the preceding statements, wherein if the calculated first score is about the same as the predetermined rule an event has not occurred.

Statement 10: The method of any of the preceding statements, further comprising: recording a second set of measurements collected from the well; processing the second set of recorded measurements to provide a second set of data; calculating a second score based on the second set of processed data; wherein the first set of processed data and the second set of processed data is the number median of absolute difference from normal; combining the first score and the second score using a weighted average; and comparing the combined scores to a predetermined rule.

Statement 11: The method of any of the preceding statements, wherein the specified time frame is split into three sections and the first score and the second score are calculated for each section using:

$$\text{score} = \frac{\text{mean}(\overrightarrow{w_N}) - \text{median}(\overrightarrow{w_H})}{\text{mad}(\overrightarrow{w_H})}$$

wherein ( $\overrightarrow{w_H}$ ) is the first set of data collected or the second set of data collected in a first section;

wherein ( $\overrightarrow{w_N}$ ) is the first set of data collected or the second set of data collected in a third section.

Statement 12: The method of any of the preceding statements, wherein if the calculated score is above the predetermined rule for all three sections an event has occurred.

Statement 13: The method of any of the preceding statements, wherein if the calculated score for at least one section is not above the predetermined rule an event has not occurred.

Statement 14: The method of any of the preceding statements, wherein the first set of measurements are recorded in at least one location selected from the group consisting of in the wellbore, at the surface of the well, and any combinations thereof.

Statement 15: A method for detecting the occurrence of an event at a well comprising: recording a first set of measurements collected from the well; processing the recorded measurements to provide a first set of data; calculating a first score based on the first set of processed data; recording a second set of measurements collected from the well; processing the second set of recorded measurements to provide a second set of data; calculating a second score based on the second set of processed data; wherein the first set of processed data and the second set of processed data is the number median of absolute difference from normal; combining the first score and the second score using a weighted average; and comparing the combined scores to a predetermined rule based on a specified time frame; and allowing an operator to adjust parameters of the well operation based on the score comparison.

Statement 16: The method of statement 15, wherein the first score and the second score are calculated using:

$$\text{score} = \frac{d - \text{median}(\vec{w})}{\text{mad}(\vec{w})}$$

wherein d is the first data set or the second data set; wherein median( $\vec{w}$ ) is a set of data points for the specified time frame in which the first set of data or the second set of data is being compared to; wherein mad( $\vec{w}$ ) is a median absolute deviation between a normal difference between a simulated first set of measurements or a simulated second set of measurements and an actual first set of measurements or an actual second set of measurements.

Statement 17: The method of statement 15 or 16, wherein if the calculated first score or second score is higher or lower than the predetermined rule an event has occurred, wherein if the calculated first score or second score is about the same as the predetermined rule an event has not occurred.

Statement 18: The method of any of the preceding statements, wherein the first score and the second score are calculated using:

$$\text{score} = \frac{d - d_{set}}{\text{mad}(\vec{w})}$$

wherein d is the first set of data collected or the second set of data collected; wherein $d_{set}$ is a predetermined set limit; and wherein mad ( $\vec{w}$ ) is a median absolute deviation between a normal difference between a simulated first set of measurements or a simulated second set of measurements and an actual first set of measurements or an actual second set of measurements.

Statement 19: The method of any of the preceding statements, wherein if the calculated first score or the calculated second score is above or below the set limit an event has occurred, wherein if the calculated first score or the calculated second score is about the same as the set limit an event has not occurred.

Statement 20: The method of any of the preceding statements, wherein the specified time frame is split into three sections and the first score and the second score are calculated for each section using:

$$\text{score} = \frac{\text{mean}(\overrightarrow{w_N}) - \text{median}(\overrightarrow{w_H})}{\text{mad}(\overrightarrow{w_H})}$$

wherein ( $\overrightarrow{w_H}$ ) is the first set of data collected or the second set of data collected in a first section;

wherein ( $\overrightarrow{w_N}$ ) is the first set of data collected or the second set of data collected in a third section; wherein if the calculated first score is above the predetermined rule for all three sections an event has occurred; and wherein if the calculated second score is above the predetermined rule for all three sections an event has occurred.

To facilitate a better understand of the present technique, the following examples of some specific embodiments are given. In no way should the following examples be read to limit, or to define, the scope of the invention.

EXAMPLES

In an example, an event such as a pack off may be indicated by an increase in difference between predicted standpipe pressure (SPP) and actual SPP at constant flow. For this example, any data acquired when the flow is not constant was filtered out. Then the predicted SPP was compared to actual SPP and rules were determined. Example rules provided for this example may be related to the following factors, but are not limited to, hole cleaning, torque output, flow rate, pressure, the like, and/or any combination thereof. This scenario may be designed to be an example of a potential rule and not a specific, detailed rule.

Figure 5:
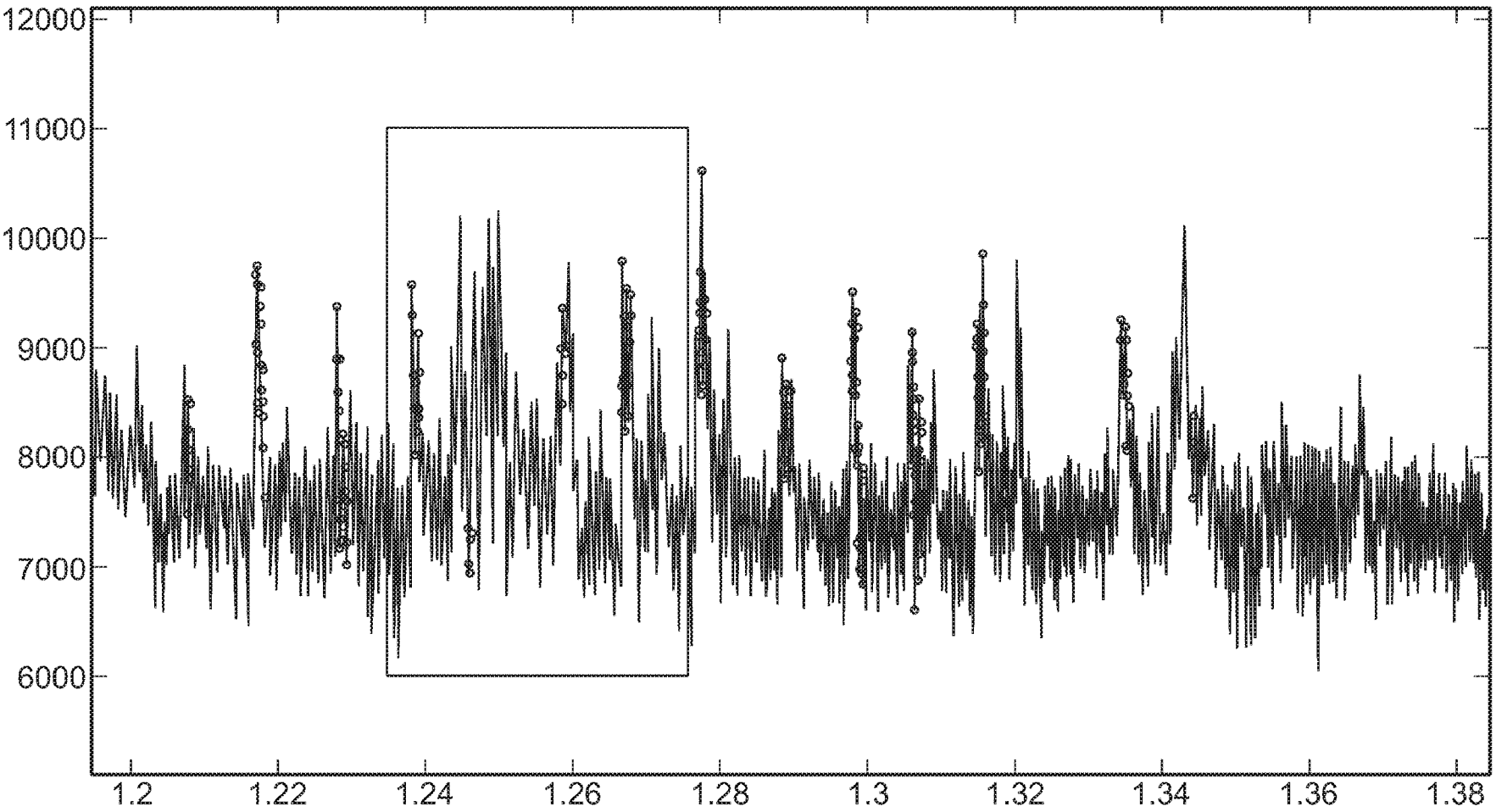
FIG. 5 illustrates an example of a window of data.

In this example, the normal difference between simulated SPP and actual SPP was then determined. A profile was create by first defining what the system looks like acting normally and then the profile was searched for a specific divergence. However these systems are very complex. Depth, fluid type, formation, ROP, and a myriad of other parameters may affect measurements throughout our calculations. To simplify the problem, we may compare the current data to a sliding window of recent data as seen in FIG. 5. In an embodiment, the window size may be selected by an operator. In an embodiment, an operator may select multiple windows. The window of data being compared may be illustrated in FIG. 5. The red arrow may point to the current data being inspected. We then calculate a score to quantify how divergent the data is from normal behavior. Scores were then compared to the rules. It was determined that an event had not occurred and the operator was automatically notified. This is merely an example, and should not limit the present disclosure herein.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular examples disclosed above are illustrative only, as the present disclosure may be modified and practiced in different but equivalent manners apparent to those skilled in the art having the benefit of the teachings herein. Although individual examples are discussed, the disclosure covers all combinations of all those examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method for detecting the occurrence of a drilling fluid properties change at a well comprising:

recording a first set of measurements collected from the well with a pressure transducer disposed on a downhole tool; wherein the measurements are collected from the drilling fluid in the well;

transmitting the recorded measurements to an information handling system for processing; wherein the information handling system is disposed on a surface of the earth; wherein the downhole tool comprises a receiver and a transmitter configured to communicate with the information handling system;

processing the recorded measurements to provide a first set of data;

calculating a first score based on the first set of processed data;

comparing the first score to a predetermined rule based on a specified time frame; and altering a flow rate of a treatment fluid mixing with the drilling fluid in the well with a valve by adjusting a flow path through the valve to alter the rate of change in the drilling fluid within the well based on the score comparison by an operator;

wherein the first score is calculated using:

$$\text{score} = \frac{d - \text{median}(\vec{w})}{\text{mad}(\vec{w})}$$

wherein d is the first data set;

wherein median ($\vec{w}$) is a set of data points for the specified time frame in which the first set of data is being compared to;

wherein mad($\vec{w}$) is a median absolute deviation between a normal difference between a simulated first set of measurements and an actual first set of measurements.

2. The method of claim 1, further comprising:

wherein the recorded measurements are processed utilizing a statistical analysis approach, a machine-learning algorithm, and any combinations thereof.

3. The method of claim 2, wherein the operator determines the predetermined rule and inputs the predetermined rule into the information handling system.

4. The method of claim 1, wherein if the calculated first score is higher or lower than the predetermined rule an event has occurred.

5. The method of claim 1, wherein if the calculated first score is about the same as the predetermined rule an event has not occurred.

6. The method of claim 1, further comprising:

recording a second set of measurements collected from the well;

processing the second set of recorded measurements to provide a second set of data;

calculating a second score based on the second set of processed data;

wherein the first set of processed data and the second set of processed data is the number median of absolute difference from normal;

combining the first score and the second score using a weighted average; and comparing the combined scores to a predetermined rule.

7. The method of claim 1, wherein the first set of measurements are recorded in the wellbore.

8. A method for detecting the occurrence of an event at a well comprising:

recording a first set of measurements collected from the well with a flow rate sensor disposed on a downhole tool; wherein the measurements are collected from a treatment fluid flowing in the well;

transmitting the recorded measurements to an information handling system for processing; wherein the information handling system is disposed on a surface of the earth; wherein the downhole tool comprises a receiver and a transmitter configured to communicate with the information handling system;

processing the recorded measurements to provide a first set of data;

calculating a first score based on the first set of processed data;

comparing the first score to a predetermined rule based on a specified time frame; and altering a flow rate of the treatment fluid with a valve by adjusting a flow path through the valve based on the score comparison by an operator;

wherein the first score is calculated using:

$$\text{score} = \frac{d - d_{set}}{\text{mad}(\vec{w})}$$

wherein d is the first set of data collected;

wherein $d_{set}$ is a predetermined set limit; and wherein mad( $\vec{w}$ ) is a median absolute deviation between a normal difference between a simulated first set of measurements and an actual first set of measurements.

9. The method of claim 8, wherein if the calculated first score is above or below the predetermined rule an event has occurred.

10. The method of claim 8, wherein if the calculated first score is about the same as the predetermined rule an event has not occurred.

11. The method of claim 8, further comprising:

wherein the recorded measurements are processed utilizing a statistical analysis approach, a machine-learning algorithm, and any combinations thereof.

12. The method of claim 11, wherein the operator determines the predetermined rule and inputs the predetermined rule into the information handling system.

13. The method of claim 8, further comprising:

recording a second set of measurements collected from the well;

processing the second set of recorded measurements to provide a second set of data;

calculating a second score based on the second set of processed data;

wherein the first set of processed data and the second set of processed data is the number median of absolute difference from normal;

combining the first score and the second score using a weighted average; and comparing the combined scores to a predetermined rule.

14. The method of claim 8, wherein the first set of measurements are recorded in the wellbore.

15. A method for detecting the occurrence of an event at a well comprising:

recording a first set of measurements collected from the well with a flow rate sensor disposed on a downhole tool; wherein the measurements are collected from a treatment fluid flowing in the well;

transmitting the recorded measurements to an information handling system for processing; wherein the information handling system is disposed on a surface of the earth; wherein the downhole tool comprises a receiver and a transmitter configured to communicate with the information handling system;

processing the recorded measurements to provide a first set of data;

calculating a first score based on the first set of processed data;

comparing the first score to a predetermined rule based on a specified time frame; and altering a flow rate of the treatment fluid with a valve by adjusting a flow path through the valve based on the score comparison by an operator;

recording a second set of measurements collected from the well;

processing the second set of recorded measurements to provide a second set of data;

calculating a second score based on the second set of processed data;

wherein the first set of processed data and the second set of processed data is the number median of absolute difference from normal;

combining the first score and the second score using a weighted average; and comparing the combined scores to a predetermined rule;

wherein the specified time frame is split into three sections and the first score and the second score are calculated for each section using:

$$\text{score} = \frac{\text{mean}(\vec{w_N}) - \text{median}(\vec{w_H})}{\text{mad}(\vec{w_H})}$$

wherein ( $\vec{w_H}$ ) is the first set of data collected or the second set of data collected in a first section;

wherein ( $\vec{w_N}$ ) is the first set of data collected or the second set of data collected in a third section.

16. The method of claim 15, wherein if the calculated score is above the predetermined rule for all three sections an event has occurred.

17. The method of claim 16, wherein if the calculated score for at least one section is not above the predetermined rule an event has not occurred.

18. The method of claim 15, further comprising:

wherein the recorded measurements are processed utilizing a statistical analysis approach, a machine-learning algorithm, and any combinations thereof.

19. The method of claim 18, wherein the operator determines the predetermined rule and inputs the predetermined rule into the information handling system.

20. The method of claim 15, wherein the first set of measurements are recorded in the wellbore.

21. A method for detecting the occurrence of a hole cleaning event at a well comprising:

recording a first set of measurements collected from the well; wherein the first set of measurements are collected from a sensor disposed on a downhole tool comprising a receiver and a transmitter configured to communicate with an information handling system;

transmitting the recorded measurements to the information handling system for processing; wherein the information handling system is disposed on a surface of the earth;

processing the recorded measurements to provide a first set of data;

calculating a first score based on the first set of processed data;

recording a second set of measurements collected from the well;

processing the second set of recorded measurements to provide a second set of data;

calculating a second score based on the second set of processed data;

wherein the first set of processed data and the second set of processed data is the number median of absolute difference from normal;

combining the first score and the second score using a weighted average; and comparing the combined scores to a predetermined rule based on a specified time frame; and altering a drilling parameter by adjusting the rate of advance of a drill bit a drilling fluid flow rate, or a drill string rotation per minute based on the score comparison by an operator to mitigate a hole cleaning event;

wherein the first score and the second score are calculated using:

$$\text{score} = \frac{d - \text{median}(\vec{w})}{\text{mad}(\vec{w})}$$

wherein d is the first data set or the second data set;

wherein median( $\vec{w}$ ) is a set of data points for the specified time frame in which the first set of data or the second set of data is being compared to;

wherein mad( $\vec{w}$ ) is a median absolute deviation between a normal difference between a simulated first set of measurements or a simulated second set of measurements and an actual first set of measurements or an actual second set of measurements.

22. The method of claim 21, wherein if the calculated first score or second score is higher or lower than the predetermined rule an event has occurred, wherein if the calculated first score or second score is about the same as the predetermined rule an event has not occurred.

23. The method of claim 21, wherein the specified time frame is split into three sections and the first score and the second score are calculated for each section using:

$$\text{score} = \frac{\text{mean}(\overrightarrow{w_N}) - \text{median}(\overrightarrow{w_H})}{\text{mad}(\overrightarrow{w_H})}$$

wherein ( $\overrightarrow{w_H}$ ) is the first set of data collected or the second set of data collected in a first section;

wherein ( $\overrightarrow{w_N}$ ) is the first set of data collected or the second set of data collected in a third section;

wherein if the calculated first score is above the predetermined rule for all three sections an event has occurred; and wherein if the calculated second score is above the predetermined rule for all three sections an event has occurred.

24. A method for detecting the occurrence of an event at a well comprising:

recording a first set of measurements collected from the well; wherein the first set of measurements are collected from a sensor disposed on a drill bit comprising a receiver and a transmitter configured to communicate with an information handling system;

transmitting the recorded measurements to the information handling system for processing; wherein the information handling system is disposed on a surface of the earth;

processing the recorded measurements to provide a first set of data;

calculating a first score based on the first set of processed data;

recording a second set of measurements collected from the well;

processing the second set of recorded measurements to provide a second set of data;

calculating a second score based on the second set of processed data;

wherein the first set of processed data and the second set of processed data is the number median of absolute difference from normal;

combining the first score and the second score using a weighted average; and comparing the combined scores to a predetermined rule based on a specified time frame; and altering rates of penetration by adjusting the rate of advance of the drill bit based on the score comparison by an operator;

wherein the first score and the second score are calculated using:

$$\text{score} = \frac{d - d_{set}}{\text{mad}(\vec{w})}$$

wherein d is the first set of data collected or the second set of data collected;

wherein $d_{set}$ is a predetermined set limit; and wherein mad( $\vec{w}$ ) is a median absolute deviation between a normal difference between a simulated first set of measurements or a simulated second set of measurements and an actual first set of measurements or an actual second set of measurements.

25. The method of claim 24, wherein if the calculated first score or the calculated second score is above or below the predetermined rule an event has occurred, wherein if the calculated first score or the calculated second score is about the same as the predetermined rule an event has not occurred.

* * * * *